US008071876B2

(12) United States Patent
Anliker et al.

(10) Patent No.: US 8,071,876 B2
(45) Date of Patent: Dec. 6, 2011

(54) METHOD FOR GROUNDING A HIGH VOLTAGE ELECTRODE

(75) Inventors: Christoph Anliker, Glashütten (CH); Reinhard Müller-Siebert, Bern (CH); Daniel Maurer, Langenthal (CH)

(73) Assignee: selFrag AG, Kerzers (CH)

( * ) Notice: Subject to any disclaimer, the term of this patent is extended or adjusted under 35 U.S.C. 154(b) by 540 days.

(21) Appl. No.: 12/282,778

(22) PCT Filed: Mar. 30, 2006

(86) PCT No.: PCT/CH2006/000183

§ 371 (c)(1),
(2), (4) Date: Jan. 19, 2009

(87) PCT Pub. No.: WO2007/112599

PCT Pub. Date: Oct. 11, 2007

(65) Prior Publication Data

US 2009/0236142 A1 Sep. 24, 2009

(51) Int. Cl.
*H01R 4/28* (2006.01)

(52) U.S. Cl. ..... 174/5 SG; 174/5 R; 174/6; 174/7; 29/854

(58) Field of Classification Search ..... 174/5 SG, 174/5 R, 6, 7; 29/854
See application file for complete search history.

(56) References Cited

U.S. PATENT DOCUMENTS

| | | | | |
|---|---|---|---|---|
| 3,604,641 | A | 9/1971 | Wilson et al. | |
| 4,621,476 | A * | 11/1986 | MacGregor | 52/741.1 |
| 6,761,858 | B2 | 7/2004 | Schultheiss et al. | |
| 7,230,179 | B1 * | 6/2007 | Ertl | 174/5 SG |
| 7,650,725 | B2 * | 1/2010 | Mead | 52/263 |
| 2007/0187539 | A1 | 8/2007 | Hoppe et al. | |

FOREIGN PATENT DOCUMENTS

| | | | |
|---|---|---|---|
| DE | 19534232 | A1 | 3/1997 |
| RU | 2002504 | C1 | 11/1993 |
| RU | 2 013 135 | C1 | 5/1994 |
| RU | 2013135 | C1 | 5/1994 |
| RU | 1 790 069 | A1 | 8/1996 |
| SU | 845843 | A1 | 7/1981 |
| WO | WO 00/43557 | | 7/2000 |
| WO | WO 2005/032722 | | 4/2005 |

OTHER PUBLICATIONS

International Search Report in corresponding PCT/CH2006/000183, Nov. 21, 2006.

* cited by examiner

*Primary Examiner* — Dhirubhai R Patel
(74) *Attorney, Agent, or Firm* — Marshall, Gerstein & Borun LLP

(57) ABSTRACT

The invention relates to an arrangement with a high voltage electrode (1) and a process vessel (2) assigned to the high voltage electrode (1), wherein the high voltage electrode (1) and the process vessel (2) can be positioned relative to each other in such a manner that the high voltage electrode (1) with its operational electrode end (5) in an operating position is immersed in the process vessel (2) and in a non-operating position is located outside the process vessel (2). Furthermore, the arrangement includes a grounding device (3), which is designed in such a manner that upon a positioning in the non-operating position it automatically is brought into contact with the operational electrode end (5) for grounding the high voltage electrode (1).

27 Claims, 4 Drawing Sheets

METHOD FOR GROUNDING A HIGH VOLTAGE ELECTRODE

TECHNICAL FIELD

The invention concerns a method for grounding a high voltage electrode of an electrodynamic fragmenting installation, an arrangement for performing the method, an installation comprising the arrangement as well as a use of the arrangement or the installation according to the preambles of the independent claims.

PRIOR ART

At the electrodynamic fragmentation, which for example can be used for a selective disintegration of concrete or slag, in a process vessel between the working end of a high voltage electrode charged with high voltage pulses and base electrode, which is typically at zero potential, high voltage breakdowns through the material that shall be fragmented are generated, causing a fragmentation of the material. In case the working end of the high voltage electrode is temporarily made accessible, e.g. for the purpose of performing maintenance or for charging the process vessel with new material, it is for reasons of operator protection necessary to ground the high voltage electrode, in order to reliably avoid the unintended occurrence of a high voltage pulse at the operational electrode end. Today, this is accomplished in that manually a grounding rod is applied to the high voltage electrode and/or the grounding switch at the high voltage generator is closed. These known measures have the disadvantage that they substantially depend on the carefulness of the service staff, so that in cases of inattention it can come to accidents. Furthermore, in many cases the grounding switch of the high voltage generator and therewith its operational status is not visible when working at the high voltage electrode. A sole grounding of the high voltage electrode via the grounding switch of the high voltage generator is furthermore problematic, because the discharge resistor which is integrated in the grounding switch might be defective and for the theoretical case that the strand of a loading coil is interrupted and at the same time there is a pressure drop in the spark gap pipe, the grounding switch is unable to perform its safety function, which as well is not visually recognizable.

DISCLOSURE OF THE INVENTION

Thus it is the objective of the invention to provide a method for grounding a high voltage electrode of a fragmenting installation as well as devices, which do not have the disadvantages of the prior art or at least partially avoid them.

This objective is achieved by the method, the arrangement and the installation according to the independent claims.

Accordingly, a first aspect of the invention relates to a method for grounding the high voltage electrode of an electrodynamic fragmenting installation in a non-operating state, in which the working end of the high voltage electrode is accessible and thus when working at or close to the working end of the electrode there exist a danger for persons in case the high voltage electrode is unintended or unnoticed, respectively, charged with high voltage. Such fragmenting installations comprise a process vessel, inside of which during the fragmenting operation the operational electrode end, a base electrode as well as the material that shall be fragmented are arranged and high voltage discharges are generated between the operational electrode end and the base electrode for fragmenting the material. Thus, the operational electrode end during operation of the installation is surrounded by the process vessel in such a manner that for persons it is not accessible. For performing the methods according to the invention a grounding device is provided by means of which the high voltage electrode can be grounded through contacting it at its operational electrode end. This grounding device is coupled to the high voltage electrode and to the process vessel in such a manner, thus is functionally connected with the arrangement formed by the process vessel and the high voltage electrode, that, when the operational electrode end becomes accessible, the grounding device automatically contacts the operational electrode end and thereby grounds the high voltage electrode. Thereafter, the operational electrode end is made accessible for persons, whereby automatically a grounding of the high voltage electrode by means of the grounding device is effected in that the operational electrode end is contacted with the grounding device in the area of the operational electrode end. As operational electrode end or working end of the high voltage electrode, respectively, is here considered that electrically conductive area of the high voltage electrode which at the side of the high voltage electrode facing towards the process vessel protrudes out of the insulator of the electrode and carries the electrode tip, from which during operation the high voltage discharges to the base electrode take place.

Through the method according to the invention a self-actuating, reliable and well visible grounding of the high voltage electrode is achieved when the operational electrode end is accessible, so that an optimal operator protection results.

In a preferred embodiment of the method, the gaining of access to the operational electrode end takes place exclusively or at least partially in that the process vessel is opened, e.g. in that an access hatch is opened or a cover is removed.

In a further preferred embodiment of the method the gaining of access to the operational electrode end takes place exclusively or at least partially in that the high voltage electrode and the process vessel are spaced away from each other, preferably in that the high voltage electrode through a lifting of same relative to the process vessel and/or lowering of the process vessel relative to the high voltage electrode is pulled out of the process vessel.

By means of this, at least in embodiments in which exclusively the process vessel is opened and/or is lowered, the advantage is arrived at that the method is also suitable for fragmenting installations in which the high voltage electrode is firmly connected with a rigid high voltage supply, what e.g. is the case in installations having oil or gas insulated high voltage supplies.

In still a further preferred embodiment of the method, a grounding device having a lever mechanism is employed. With the lever mechanism, a grounded contact area is applied to the operational electrode end, whereby the high voltage electrode is grounded.

In that case it is preferred that the motion for applying the contact area to the operational electrode end is exclusively or at least partially effected by gravity and/or spring forces.

For this, the grounding device preferably is designed in such a manner and coupled to the high voltage electrode and the process vessel in such a manner that a lever of the lever mechanism, which lever carries the contact area, when the operational electrode end becomes accessible, automatically is released in order to then, fully or partially driven by gravity and/or spring forces, being moved towards the operational electrode end, where its movement is stopped through an abutment of the contact area against the operational electrode end.

By these measures it is possible to achieve in a simple way a reliable grounding, last but not least also because a certain contact pressure of the contact area to the operational electrode end of the high voltage electrode is guaranteed.

If in this case the lever which carries the contact area is released by the upper edge of the process vessel, what is preferred, a very simple and visually recognizable coupling between grounding device and process vessel results.

In still a further preferred embodiment of the method, in which a grounding device having a lever mechanism is employed, the grounding device is designed and coupled with the high voltage electrode and the process vessel in such a manner that the applying of the contact area to the operational electrode end takes place in a mechanically compulsory coupled manner, thus the gaining of access to the operational electrode end inevitably by way of mechanical means leads to the application of the contact area to the operational electrode end and thereby to the grounding of the high voltage electrode. By means of this, a maximum of safety can be achieved.

In still a further preferred embodiment of the method, in which a grounding device having a lever mechanism is employed, the lever mechanism comprises exactly one moveable lever, wherein this lever for application of the contact area to the operational electrode end is pivoted around a preferably horizontal or vertical axis of rotation. Such lever mechanism comprise a minimum of moving parts and are robust and inexpensive.

In case when moving the lever for applying the contact area to the operational electrode end the lever additionally is displaced along the axis of rotation, what is preferred, two-dimensional pivoting movements can be realized in a simple manner, which is in particular of advantage at cramped space conditions.

In still a further preferred embodiment of the method, the contact between the operational electrode end and the grounding device is established by means of a grounded contact brush, whereby a reliable grounding even with a soiled high voltage electrode can be ensured.

A second aspect of the invention relates to an arrangement which is suitable for performing the method according to the first aspect of the invention. The arrangement comprises a high voltage electrode and a process vessel assigned to the high voltage electrode, in which vessel during the intended operation of the arrangement, e.g. as a part of an electrodynamic fragmenting installation, pulsed high voltage discharges take place between the operational electrode end and a base electrode. In that case the high voltage electrode and the process vessel are moveable relative to each other in such a manner that optionally they can be positioned in an operating position, in which the high voltage electrode with its operational electrode end is immersed in the process vessel, and in an non-operating position, in which the operational electrode end is arranged outside of the process vessel. Furthermore, the arrangement comprises a grounding device. The grounding device is designed and coupled to the high voltage electrode and the process vessel in such a manner that upon a positioning in the non-operating position or upon a change from the operating position to the non-operating position, respectively, it is automatically brought into contact with the operational electrode end and thereby grounds the high voltage electrode.

By the arrangement according to the invention it becomes possible to provide electrodynamic fragmenting installations in which the high voltage electrode, when its operational electrode end becomes accessible, in a self actuated and reliable manner is grounded and furthermore the grounding is visually recognizable. Through this, the operator protection can significantly be improved.

In a preferred embodiment of the arrangement, the grounding device is furthermore designed and coupled with the high voltage electrode and the process vessel in such a manner that, upon positioning in the operating position or upon a change from the non-operating position to the operating position, respectively, it is automatically brought out of contact with the operational electrode end, whereby the grounding of the high voltage electrode is abolished and the generation of high voltage discharges between the high voltage electrode and the base electrode is rendered possible.

In a further preferred embodiment of the arrangement, the grounding device of the arrangement comprises a lever mechanism, by means of which for grounding and abolishing of the grounding, respectively, of the high voltage electrode a contact area can be brought into contact and out of contact, respectively, with the operational electrode end.

In that case the lever mechanism preferably is designed in such a manner that in one of its two directions of movement it is exclusively or at least partially driven by gravity and/or spring forces, wherein it is preferred that this is the direction of movement in which the bringing into contact of the contact area with the operational electrode end can be effected.

Arrangements with such grounding devices have the advantage that they are simple and inexpensive and that the correct functioning of the grounding device can visually be checked in a simple manner. In the latter variant furthermore the advantage is arrived at that the contact area with a certain contact pressure abuts against the operational electrode end and thereby a reliable contact is ensured.

In still a further preferred embodiment of the arrangement, the lever mechanism is in such manner coupled or functionally connected, respectively, with the high voltage electrode and the process vessel that the contact area, upon a movement of the high voltage electrode and the process vessel relative to each other from the non-operating position to the operating position, through mechanical compulsory coupling is lifted and removed from the operational electrode end.

In that case the mechanical compulsory coupling by advantage is realized in such a manner that the a lever of the lever mechanism, which lever is carrying the contact area, is pushed away by the process vessel, namely preferably by the upper edge of the process vessel, and thereby the contact area is lifted and removed from the operational electrode end.

In this way it is possible to realize a simple and robust mechanical compulsory coupling of the grounding device with the high voltage electrode and the process vessel in this direction of movement, which furthermore can easily visually be understood.

For this, the lever carrying the contact area is designed in such a manner that it comprises a curved abutment track for the upper edge of the process vessel, along which the upper edge during the pushing away action contacts the lever. Through this the advantage is arrived at that the force component which in horizontal direction acts on the process vessel is limited, what in particular at small size, unsecured process vessels leads to the advantage that the risk of an overturning of the vessel is considerably reduced.

In case the lever of the grounding device furthermore is designed in such a manner and the contact area is arranged at it in such a manner that a contacting of the contact area with the process vessel during the pushing away of the lever in made impossible, what is preferred, the use of delicate contact areas, like e.g. contact brushes, is rendered possible, which otherwise easily could be damaged.

In still a further preferred embodiment of the arrangement the lever mechanism is coupled or functionally connected, respectively, with the high voltage electrode and the process vessel in such a manner that the contact area, upon a movement of the high voltage electrode and the process vessel relative to each other from the operating position to the non-operating position, through mechanical compulsory coupling is moved towards the high voltage electrode and applied to the operational electrode end. Through the compulsory coupling in this direction of movement the advantage results that the gaining of access to the operational electrode end necessarily effects a grounding of the high voltage electrode, by means of which a maximum of safety can be achieved. Furthermore it is envisaged to perform the mechanically compulsory coupled movement assisted by gravity and/or spring forces.

In still a further preferred embodiment of the arrangement, the lever mechanism comprises exactly one moveable lever, which for bringing into contact and bringing out of contact, respectively, of the contact area with the operational electrode end can be pivoted around a preferably horizontal or vertical axis of rotation. Such lever mechanisms have a minimum of moveable parts and are robust and inexpensive.

In that case it is preferred that the lever, for bringing into contact and bringing out of contact, respectively, of the contact area with the operational electrode end, is furthermore displaceable along the axis of rotation. In this way, also complex, multi-dimensional pivoting motions can be realized with only a marginal additional effort from the design side.

In still a further preferred embodiment of the arrangement, the contact area is formed by a contact brush, which leads to the advantage that also with a soiled operational electrode end a reliable grounding can be achieved.

In still a further preferred embodiment, the arrangement is designed in such a manner that the relative movement between the high voltage electrode and the process vessel which is necessary for positioning in the non-operating position and in the operating position, respectively, can be effected through a lowering and lifting, respectively, of the process vessel relative to the high voltage electrode, e.g. by means of a lifting table which carries the process vessel, wherein it is preferred that this can take place with a at the same time stationary high voltage electrode. Due to this, there is the advantage that the arrangement according to the invention can also be used for installations in which the high voltage electrode is connected to a rigid high voltage supply, what in particular is the case in installations having oil or gas insulated high voltage supplies.

A third aspect of the invention relates to an installation with an arrangement according to the second aspect of the invention and with a high voltage pulse generator for charging the high voltage electrode with high voltage pulses. At such installations, the advantages of the invention become especially clearly apparent.

A fourth and last aspect of the invention relates to the use of the arrangement according to the second aspect of the invention or of the installation according to the third aspect of the invention for electrodynamic fragmentation of an electrically poorly conductive material, in particular of concrete or slag.

BRIEF DESCRIPTION OF THE DRAWINGS

Further embodiments, advantages and applications of the invention become apparent from the depending claims and from the following description with reference to the drawings. Therein show:

the FIGS. 1*a* and 1*b* schematic illustrations of a first arrangement according to the invention in a non-operating position and in an operating position;

Figure 2B:
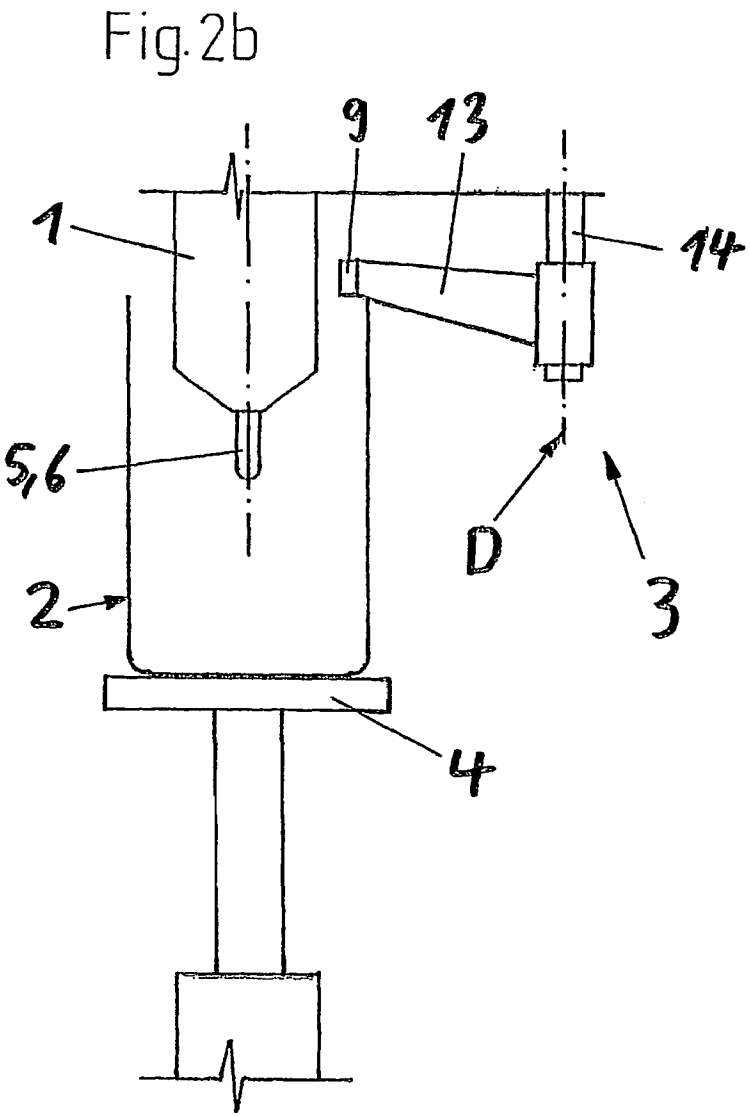
Figure 2A:
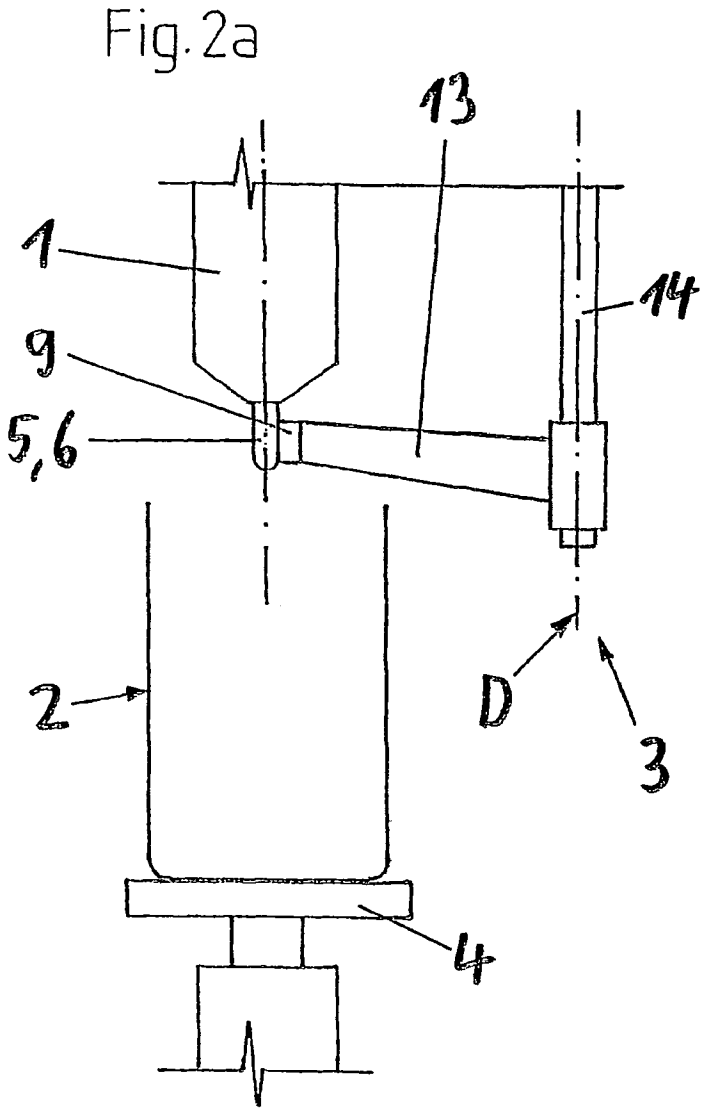
Figure 3B:
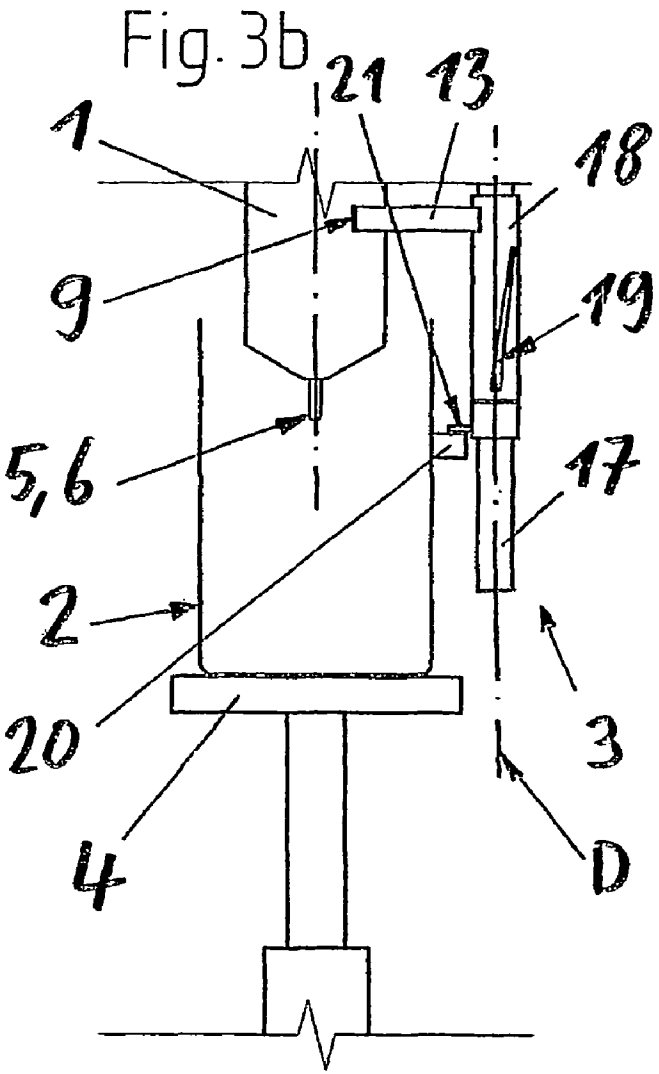
Figure 3A:
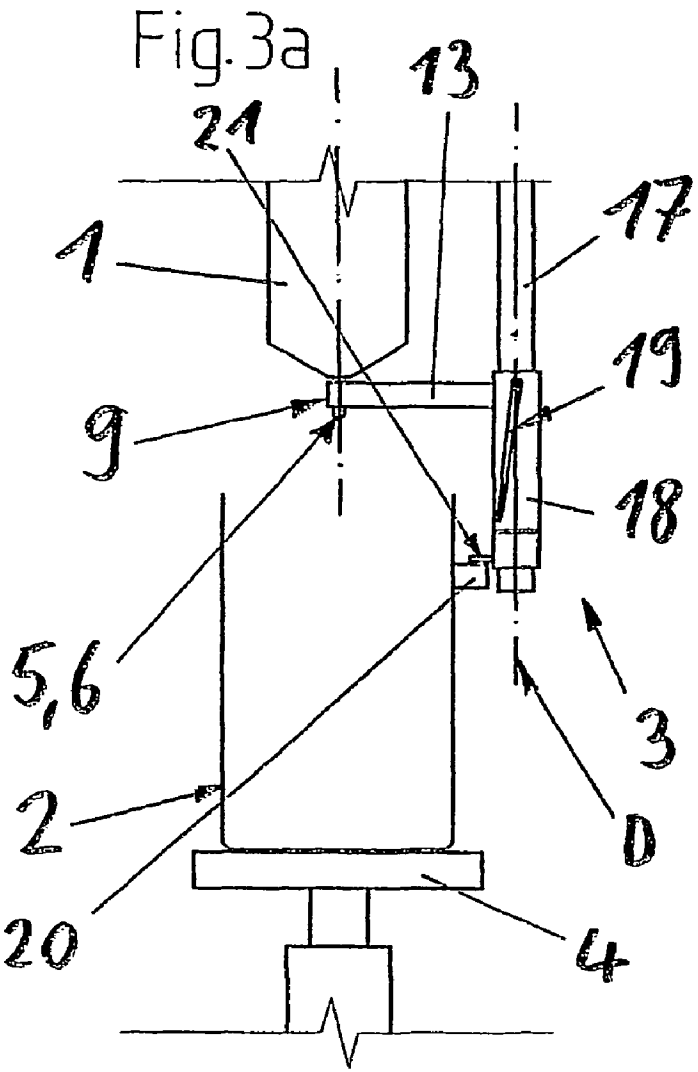
Figure 4:
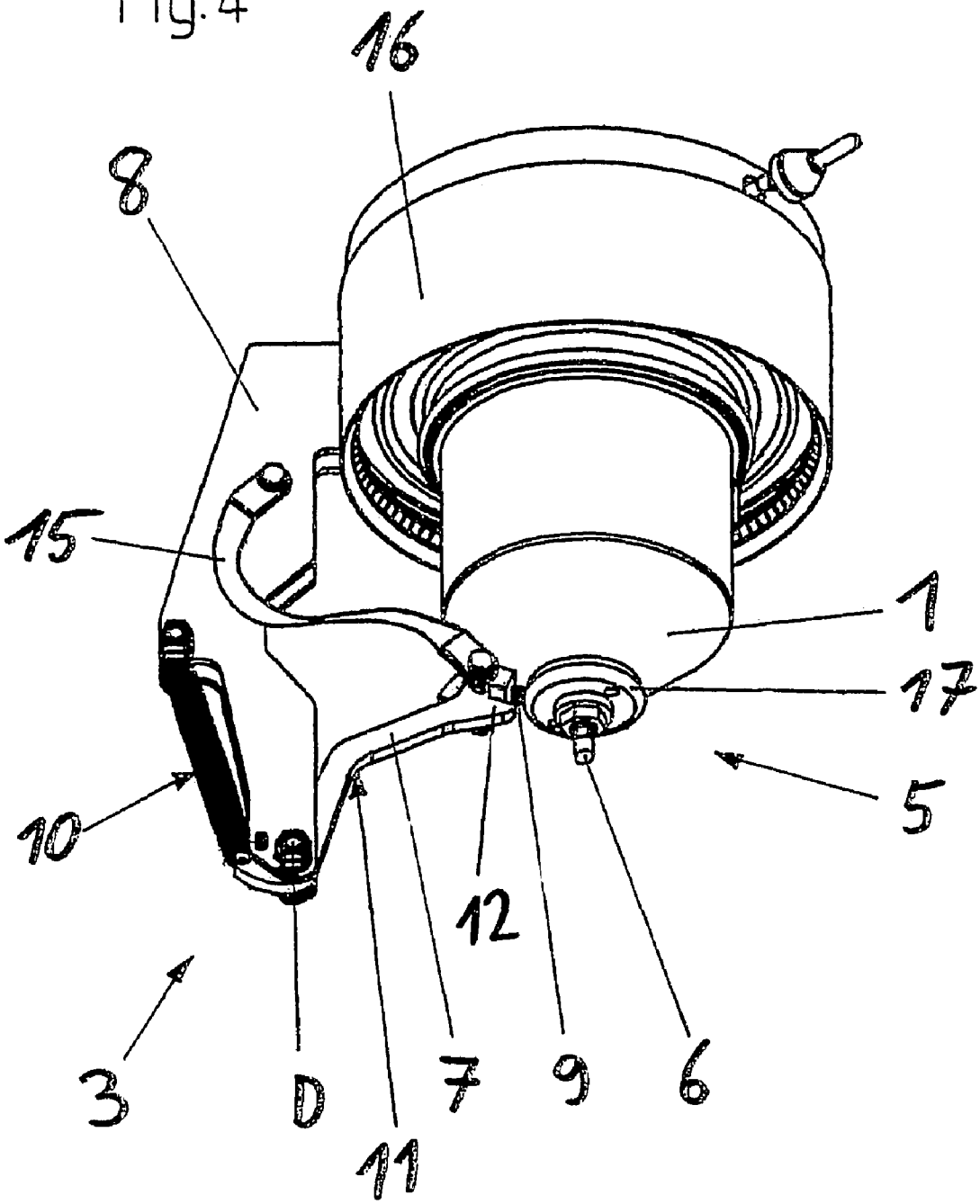

the FIGS. 2*a* and 2*b* schematic illustrations of a second arrangement according to the invention in a non-operating position and in an operating position;

the FIGS. 3*a* and 3*b* schematic illustrations of a third arrangement according to the invention in a non-operating position and in an operating position; and FIG. 4 a perspective view of a high voltage electrode with grounding device for an arrangement according to the invention.

MODES FOR CARRYING OUT THE INVENTION

Figure 1B:
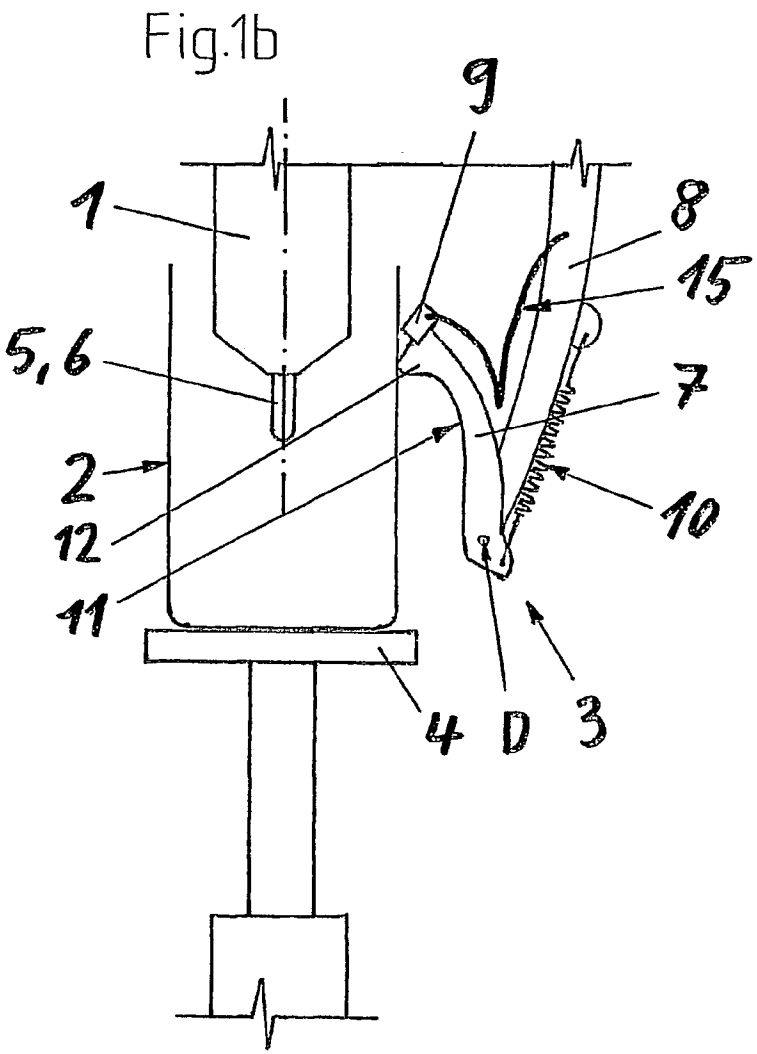
Figure 1A:
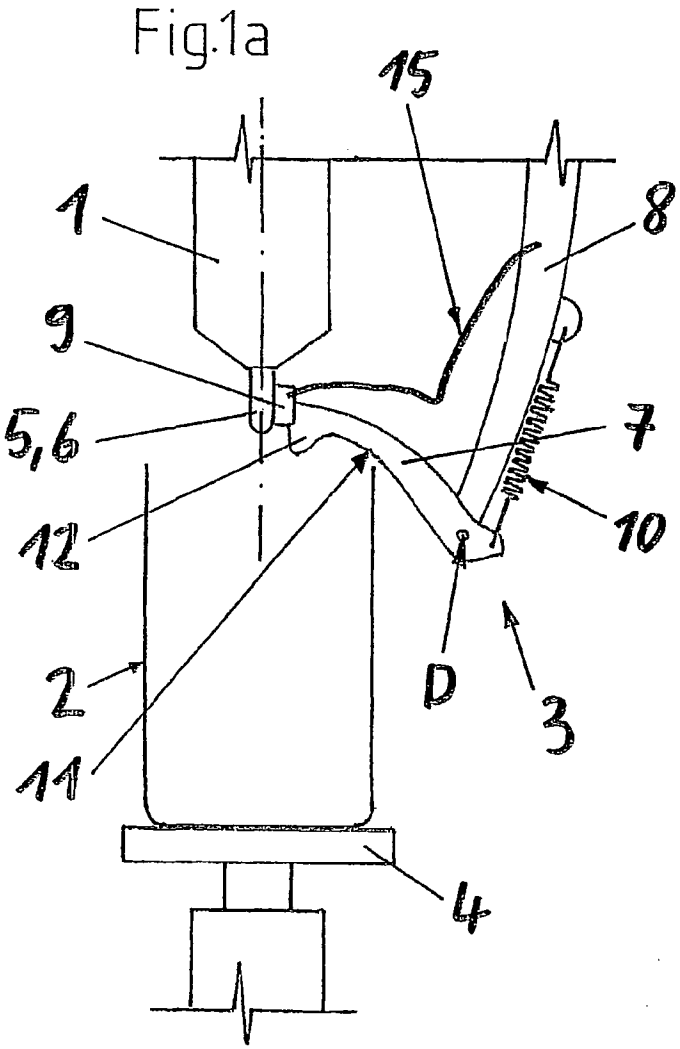

The FIGS. 1*a* and 1*b* show in each case a schematic illustration of a first arrangement according to the invention in the lateral view, namely once in a non-operating position (FIG. 1*a*) and once in a operating position (FIG. 1*b*). As can be seen, the arrangement comprises a stationary high voltage electrode 1, a process vessel 2, which is vertically moveable by means of a lifting table 4, as well as a grounding device 3, which is mounted to the structure (not shown) that carries the high voltage electrode 1.

In the non-operating position shown in FIG. 1*a*, the operational electrode end 5 of the high voltage electrode 1, which end forms the electrode tip 6, is accessible and is grounded by means of the grounding device 3. This grounding device comprises a double-sided pivoted lever 7, which, in a manner so that it can be pivoted around a horizontal axis of rotation D, is fastened to a stationary support arm 8 and carries at one of its two free ends a contact brush 9 that is grounded via a flexible strand 15, by means of which brush it contacts the electrode tip 6 and therewith grounds same. At its other free end, the pivoted lever 7 is over a tension spring 10 connected with the support arm 8 in such a manner that the contact brush 9 through the spring force of the tension spring 10 is pressed against the electrode tip 6. At the bottom side of its lever side which carries the contact brush 9, the pivoted lever 7 comprises a curved contour 11, which, as will be illustrated in the following, serves as curved abutment track 11 for the upper edge of the process vessel 2.

If now starting from the non-operating position illustrated in FIG. 1*a* the process vessel 2 is lifted by means of the lifting table 4, the upper edge of the process vessel comes into contact with the bottom side of the pivoted lever 7 and presses same upwards, whereby the contact brush 9 is lifted and removed from the electrode tip 6. In doing so, the upper edge of the process vessel 2 travels along the curved abutment track 11 until it reaches the outermost end of the pivoted lever 7, which carries the contact brush 9 and is embodied as a protruding nose 12. In this state, the pivoted lever 7 and the contact brush 9 are located completely outside of the aperture of the process vessel 2 and upon a further lifting of the process vessel 2, the pivoted lever 7 with its nose 12 slides along the exterior of the process vessel 2 until the operating position illustrated in FIG. 1*b* is reached. As is visible, the end sided nose 12 of the pivoted lever 7 in that case is designed in such a manner that a contacting of the contact brush 9 with the process vessel 2, and by that the possibility of damaging the contact brush 9, is reliably obviated.

When the process vessel 2 is again lowered in order to obtain the non-operating position with accessible operational electrode end 5 that is illustrated in FIG. 1*a*, the same course takes place analogously in reversed manner, wherein however the automated returning of the pivoted lever 7 and the applying of the contact brush 9 to the electrode tip 6 substantially takes place driven by the spring force of the tension spring 10. This in contrast to the opposite movement direction described before, in which the movement takes place through mechanical compulsory coupling with the upward movement of the process vessel 2 that is effectuated by the lifting table 4 and against the spring force.

The FIGS. 2*a* and 2*b* show illustrations like the FIGS. 1*a* and 1*b* of a second arrangement according to the invention, which differs from the before described first arrangement according to the invention merely in that it comprises a different grounding device 3. As is visible, the grounding device 3 in this case comprises a single-sided pivoted lever 13, which at its free end carries a contact brush 9, by means of which it contacts and grounds the electrode tip 6. The pivoted lever 13 is rigidly fastened to a supporting pillar 14 which is rotatable around a vertical axis of rotation D. The supporting pillar 14 is supported in such a manner that upon a rotation around the axis of rotation D it simultaneously moves upwards along its longitudinal axis, what in the present case is effectuated in that the axial support of the supporting pillar 14 consists of a roller, which is supported by a curved track (not shown). Through this there results, because of the weight of the pivoted lever 13 and of the supporting pillar 14, in addition a driving torque around the axis of rotation D, which acts in rotation direction towards the high voltage electrode 1, so that the contact brush 9 is pressed against the electrode tip 6.

When now, starting from the non-operating position illustrated in FIG. 2*a*, the process vessel 2 is lifted by means of the lifting table 4, the upper edge comes into contact with the bottom side of the pivoted lever 13 and presses said lever together with the supporting pillar 14 upwards, whereupon the pivoted lever 13 inevitably must perform a rotation around the vertical axis of rotation of the supporting pillar 14 and the contact brush 9 is lifted and removed from the electrode tip 6. In doing so, the upper edge of the process vessel 2 travels along the bottom side of the pivoted lever 13 until the operating position illustrated in FIG. 2*b* is reached. As can be seen, in this operating position the pivoted lever 13 rests, in the area of its free end, on the process vessel 2, while the contact brush 9 stays in the area of the aperture of the process vessel 2.

In case the process vessel 2 is lowered again in order to obtain the non-operating situation with accessible operational electrode end 5 illustrated in FIG. 2*a*, the same course takes place analogously in reversed manner, wherein however the automated returning of the pivoted lever 13 and the applying of the contact brush 9 to the electrode tip 6 substantially is effectuated through the before mentioned driving torque around the axis of rotation D which torque is derived from the weights of the pivoted lever 13 and the supporting pillar 14.

The FIGS. 3*a* and 3*b* show illustrations like the FIGS. 2*a* and 2*b* of a third arrangement according to the invention, which is quite similar to the before described second arrangement according to the invention. Also here the grounding device 3 comprises a single-sided pivoted lever 13, which at its free end carries a contact brush 9 by means of which it contacts and grounds the electrode tip 6. The important difference to the arrangement illustrated in the FIGS. 2*a* and 2*b* consists in that here a stationary supporting pillar 17 is employed and that the pivoted lever 13 is interconnected with the supporting pillar 17 via a guiding sleeve 18 having a curved track 19, in which track a roller (not shown) that is firmly affixed to the supporting pillar 17 engages in such a manner that the pivoted lever can be rotated relative to the supporting collar 17 around the axis of rotation D at a simultaneous vertical displacement along this axis D. Accordingly, the same mechanical principle is employed here as in the arrangement according to the FIGS. 2*a* and 2*b*, however with the difference, that here the component 18, which forms the curved track 19, is moveable, while the component 17, which carries the roller, is stationary. Correspondingly, also here a driving torque around the axis of rotation D results due to the weights of the pivoted lever 13 and the guiding sleeve 18, which acts in rotation direction towards the high voltage electrode 1, so that the contact brush 9 is pressed against the electrode tip 6.

A further difference of this arrangement compared to the one shown in the FIGS. 2*a* and 2*b* exists in that the coupling between the process vessel 2 and the pivoted lever 13 does not take place due to a resting of the pivoted lever 13 on the upper edge of the vessel but in that an actuator protrusion 20 arranged at the side wall of the vessel interacts with a suitable actuator protrusion 21 of the guiding sleeve 18.

When now starting from the non-operating position illustrated in FIG. 3*a* the process vessel 2 is lifted by means of the lifting table 4, the upper edge of the actuator protrusion 20 of the process vessel 2 comes into contact with the bottom side of the actuator protrusion 21 of the guiding sleeve 18 and pushes the guiding sleeve 18 upwards, whereupon the pivoted lever 13 necessarily must perform a rotation around the vertical axis of rotation D of the supporting collar 17 and the contact brush 9 is lifted and removed from the electrode tip 6. The movement is stopped in the operating position illustrated in FIG. 3*b*, if need be through an abutment of the lower end of the curved track 19 at the roller. As can be seen, the pivoted lever 13 in this operating position is located with the contact brush 9 laterally beside the high voltage electrode 1 outside of the aperture of the process vessel 2.

When the process vessel 2 again is lowered in order to again obtain the non-operating position with accessible operational electrode end 15 illustrated in FIG. 3*a*, the same course takes place analogously in reversed manner, wherein however the automated returning of the pivoted lever 13 and the applying of the contact brush 9 to the electrode tip 6 substantially is effectuated through the before mentioned driving torque around the axis of rotation D, which torque is derived from the weights of the pivoted lever 13 and the guiding sleeve 18.

Even though in the before shown arrangements according to the invention merely the abolishing of the grounding of the high voltage electrode is effectuated in a mechanically compulsory coupled manner through a lifting of the process vessel 2 by means of the lifting table 4, while the grounding of the electrode upon a lowering of the process vessel 2 and gaining of access to the operational electrode end 5 takes places substantially driven by spring or gravity forces, it is however also envisaged to have a mechanically compulsory coupled grounding movement, e.g. in that in the arrangement illustrated in the FIGS. 1*a* and 1*b* the lifting table 4 via tension means, like e.g. a steel cable or a tension rod, is interconnected with the side of the pivoted lever 7 which carries the contact brush.

FIG. 4 shows a perspective view of a concrete embodiment of the high voltage electrode with grounding device that is in the FIGS. 1*a* and 1*b* schematically illustrated, which together with an associated process vessel would form an arrangement according to the invention. For the mode of operation in connection with a process vessel, reference is made to the description of the before mentioned FIGS. 1*a* and 1*b*. As is visible, the operational electrode end 5 of the high voltage electrode 1 here is formed by a discoidal field release 17 and an interchangeable electrode tip 6, which is centrally screwed into said field release. Furthermore, the high voltage electrode 1 carries a concentric collar 16 for surrounding the aperture of an associated process vessel (not shown) in operation, to which collar the supporting arm 8 of the grounding device 3 is attached. The double-sided pivoted lever 7, in a manner that it can be pivoted around the horizontal axis of rotation D, is mounted to the supporting arm 8 and carries at its lever side facing towards the electrode a contact brush 9, which via a flexible strand 15 is connected with the grounded supporting bracket 8, which brush in the illustrated situation abuts against the field release 17 and thereby grounds the high voltage electrode 1. Also here, the outermost end of the pivoted lever 7 forms a protruding nose 12, which as has already been described with respect to the FIGS. 1*a* and 1*b* serves the purpose of obviating a contacting of the contact brush 9 with the process vessel 2 and a possible subsequent damaging of said brush. The side of the double-sided pivoted lever 7 which is facing away from the high voltage electrode 1 is via a tension spring 10 interconnected with the support arm 8 in such a manner that the contact brush through the spring force of the tension spring 10 is pressed against the field release 17. At the bottom side of its lever side which is carrying the contact brush 9 and is facing towards the electrode, the pivoted lever 7 comprises a curved abutment track 11 for the upper edge of a process vessel 2.

While in the present application there are described preferred embodiments of the invention, it is to be distinctly understood that the invention is not limited thereto but may be otherwise variously embodied within the scope of the following claims.

The invention claimed is:

1. Method for grounding a high voltage electrode of an electrodynamic fragmenting installation in an off-state, wherein the fragmenting installation comprises a process vessel which encloses an operational electrode end during operation in such a manner that said end is inaccessible during operation, comprising the steps:

providing a grounding device for grounding of the high voltage electrode by contacting said electrode in an area of said end;

coupling the grounding device with the high voltage electrode and the process vessel in such a manner that the grounding device automatically contacts said end upon a gaining of access to said end for grounding the high voltage electrode; and gaining access to said end with automatic grounding of the high voltage electrode by means of the grounding device.

2. Method according to claim 1, wherein the gaining of access to said end at least partially takes place through an opening of a subarea of boundary walls of the process vessel.

3. Method according to one of the preceding claims, wherein the gaining of access to the operational electrode end at least partially takes place through moving away the high voltage electrode and the process vessel from each other, in particular through pulling the high voltage electrode out of the process vessel by means of one or more of lifting the high voltage electrode or lowering the process vessel.

4. Method according to one of the preceding claims, wherein the grounding device is used which comprises a lever mechanism by means of which lever mechanism a contact area is applied to said end for grounding the high voltage electrode.

5. Method according to claim 4, wherein applying motion at least partially is driven by one or more of gravity or spring forces.

6. Method according to claim 5, wherein the grounding device is designed and coupled to the high voltage electrode in such a manner that a lever of the lever mechanism, which lever is carrying the contact area upon a gaining of access to said end is released and at least partially driven by one or more of gravity or spring forces, is moved towards said end until the contact area abuts against said electrode end.

7. Method according to claim 6, wherein the lever which is carrying the contact area through a moving, in particular through a lowering of an upper edge of the process vessel is released.

8. Method according to claim 4, wherein the grounding device is designed and coupled to the high voltage electrode and to the process vessel in such a manner that an applying of the contact area to the operational electrode end takes place in a mechanically compulsory coupled manner.

9. Method according to claim 4, wherein the lever mechanism having only one single movable lever is used, which for applying the contact area to the operational electrode end is pivoted around a in particular horizontal or vertical axis of rotation.

10. Method according to claim 9, wherein the lever for applying the contact area additionally is displaced along the horizontal or vertical axis of rotation.

11. Method according to claim 4, wherein contact between said end and the grounding device is established by means of a contact brush.

12. Arrangement for performing a method comprising a high voltage electrode and a process vessel assigned to the high voltage electrode, wherein the high voltage electrode and the process vessel are moveable relative to each other in such a manner that they can be positioned in at least one operating position, in which the high voltage electrode with its operational electrode end is immersed in the process vessel, and in a non-operating position, in which the operational electrode end is disposed outside the process vessel, and with a grounding device, which is designed in such a manner that, upon a positioning in the non-operating position, it automatically is brought into contact with the operational electrode end in order to ground the high voltage electrode.

13. Arrangement according to claim 12, wherein the grounding device is furthermore designed in such a manner that, upon a positioning in the operating position, it automatically is moved out of contact with the operational electrode end for abolishing grounding in order to render possible high voltage discharges starting from the high voltage electrode.

14. Arrangement according to claim 13 wherein the grounding device comprises a lever mechanism, by means of which a contact area can be brought into contact and out of contact, respectively, with the operational electrode end, for grounding and abolishing the grounding, respectively, of the high voltage electrode.

15. Arrangement according to claim 14, wherein the lever mechanism is designed in such a manner; that its movement in one of its two moving directions fully or partially is one or more of gravity or spring force driven, in particular in a moving direction, in which the contact area can be brought into contact with the operational electrode end.

16. Arrangement according to claim 15, wherein the lever mechanism is coupled to the high voltage electrode and to the process vessel in such a manner that the contact area, upon a moving of the high voltage electrode and the process vessel relative to each other from the non-operating position to the operating position, is lifted and removed from the operational electrode end of the high voltage electrode in a mechanically compulsory coupled manner.

17. Arrangement according to claim 16, wherein the mechanical compulsory coupling is realized in such a manner that a lever of the lever mechanism, which lever is carrying the contact area, is pushed away by the process vessel, in particular by an upper edge of the process vessel or by an actuator element arranged outside of the process vessel, and thereby the contact area is lifted off and removed from the operational electrode end.

18. Arrangement according to claim 17, wherein the lever which is carrying the contact area comprises a curved track for abutment of the upper edge of the process vessel.

19. Arrangement according to claim 18, wherein the lever is designed and the contact area is arranged at it in such a manner that a contacting of the contact area with the process vessel during pushing away of the lever is reliably obviated.

20. Arrangement according to claim 16, wherein the mechanical compulsory coupling is realized in such a manner that a component which carries the lever of the lever mechanism which lever carries the contact area is pushed away by the process vessel, in particular by an upper edge of the process vessel or by an actuator element arranged at an outside of the process vessel, and thereby the contact area is lifted-off and removed from the operational electrode end.

21. Arrangement according to claim 20, wherein the lever mechanism is coupled to the high voltage electrode and to the process vessel in such a manner that the contact area, upon a moving of the high voltage electrode and the process vessel relative to each other from the operating position to the non-operating position, in a mechanically compulsory coupled manner is moved towards the high voltage electrode and applied to the operational electrode end of the high voltage electrode.

22. Arrangement according to claim 21, wherein the lever mechanism comprises one single moveable lever only, which, for bringing the contact area into contact and out of contact, respectively, with the operational electrode end, is pivotable around a horizontal or vertical axis of rotation.

23. Arrangement according to claim 22, wherein the lever for bringing the contact area into contact and out of contact, respectively, with the operational electrode end, in addition is displaceable along the axis of rotation.

24. Arrangement according to claim 23, wherein the contact area is formed by a contact brush.

25. Arrangement according to claim 24, wherein the arrangement is designed in such a manner that a relative movement between the high voltage electrode and the process vessel, which is necessary for the positioning in the non-operating position and the operating position, respectively, can be effected through a lowering and lifting, respectively, of the process vessel, in particular while at a same time the high voltage electrode is stationary.

26. Installation comprising an arrangement according to claim 25 and comprising a high voltage pulse generator for charging the high voltage electrode with high voltage pulses.

27. Use of the arrangement or of the installation according to claim 26 for an electrodynamic fragmentation of in particular electrically poorly conductive material, in particular of concrete or slag.

* * * * *